US010619938B2

(12) United States Patent
Kawaguchi et al.

(10) Patent No.: US 10,619,938 B2
(45) Date of Patent: Apr. 14, 2020

(54) HEAT EXCHANGE MEMBER

(71) Applicant: NGK INSULATORS, LTD., Nagoya (JP)

(72) Inventors: Tatsuo Kawaguchi, Nagoya (JP); Makoto Miyazaki, Nagoya (JP); Yoshimasa Kondo, Nagoya (JP); Hironori Takahashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 1875 days.

(21) Appl. No.: 14/140,918

(22) Filed: Dec. 26, 2013

(65) Prior Publication Data

US 2014/0102683 A1 Apr. 17, 2014

Related U.S. Application Data

(63) Continuation of application No. PCT/JP2012/066790, filed on Jun. 29, 2012.

(30) Foreign Application Priority Data

Jun. 30, 2011 (JP) ..... 2011-145878

(51) Int. Cl.
*F28D 7/02* (2006.01)
*F28D 15/00* (2006.01)
(Continued)

(52) U.S. Cl.
CPC ..... *F28D 15/00* (2013.01); *F28F 21/04* (2013.01); *F28D 21/0003* (2013.01); *F28F 2265/26* (2013.01)

(58) Field of Classification Search
CPC ..... F28F 21/04; F28F 21/062; F28F 21/081; F28F 7/02; F28F 27/02; F28D 21/003;
(Continued)

(56) References Cited

U.S. PATENT DOCUMENTS 3,825,064 A * 7/1974 Inoue ..... B22F 7/002 165/10
3,983,283 A 9/1976 Bagley
(Continued)

FOREIGN PATENT DOCUMENTS

JP 50-70155 U 6/1975
JP 56-133598 A1 10/1981
(Continued)

OTHER PUBLICATIONS

U.S. Appl. No. 13/491,709, filed Jun. 8, 2012, Suzuki et al.
(Continued)

*Primary Examiner* — Henry T Crenshaw
*Assistant Examiner* — Kamran Tavakoldavani
(74) *Attorney, Agent, or Firm* — Burr & Brown, PLLC

(57) ABSTRACT

A heat exchange member which does not easily suffer from breakage due to thermal stress by relaxing the thermal stress. The heat exchange member is provided with a honeycomb structure and a covering member. The outer peripheral wall of the honeycomb structure has at least one slit. The covering member covers the honeycomb structure so that the heat exchange can be carried out between a first fluid and a second fluid. The heat exchange member performs heat exchange by means of the outer peripheral wall of the honeycomb structure and the covering member in the state where the first fluid passing through the cells and the second fluid passing through the outside of the covering member are not mixed with each other.

21 Claims, 7 Drawing Sheets

(51) Int. Cl.
*F28F 21/04* (2006.01)
*F28D 21/00* (2006.01)

(58) Field of Classification Search
CPC ..... F28D 15/046; F28D 15/0275; F28D 15/0266; F28D 15/0233; F28D 19/041; F28D 19/045; F28D 1/0417; F28D 1/0461; F28D 1/05308; F28D 7/022; F28D 15/00; F28D 21/0003; F01N 3/2889; F01N 5/02; F01N 3/24; Y02T 10/16
USPC ..... 165/51, 52, 154, 164, 8
See application file for complete search history.

(56) References Cited

U.S. PATENT DOCUMENTS 4,421,702 A 12/1983 Oda et al.
4,601,332 A 7/1986 Oda et al.
5,729,902 A * 3/1998 Wieres ..... B01J 35/04 29/890
5,952,079 A * 9/1999 Andou ..... B28B 3/269 210/500.21
6,260,612 B1 * 7/2001 Nakamura ..... F28D 9/0075 165/149
6,390,186 B1 * 5/2002 Laudic ..... F28D 7/16 165/158
6,696,131 B1 2/2004 Nishimura et al.
2005/0034847 A1 * 2/2005 Graham ..... F28F 9/02 165/158
2010/0139885 A1 * 6/2010 Hoffman ..... F02G 1/057 165/7
2010/0270011 A1 * 10/2010 Takahashi ..... F28D 7/0025 165/148
2011/0311761 A1 * 12/2011 Boulet ..... B01D 53/0462 428/107
2012/0247732 A1 10/2012 Suzuki et al.

FOREIGN PATENT DOCUMENTS

JP 61-024997 A1 2/1986
JP S61-76891 A 4/1986
JP 62-009183 A1 1/1987
JP 04-129666 U 11/1992
JP 06-345555 A1 12/1994
JP 07-100390 A1 4/1995
JP 07-286797 A1 10/1995
JP 2001-021277 A 1/2001
JP 2001-046886 A1 2/2001
JP 2002-316879 A1 10/2002
JP 2002-350092 A1 12/2002
JP 2008-292017 A1 12/2008
WO 2011/071161 A1 6/2011

OTHER PUBLICATIONS

U.S. Appl. No. 14/036,379, filed Sep. 25, 2013, Suzuki et al.
U.S. Appl. No. 13/852,144, filed Mar. 28, 2013, Miyazaki et al.
U.S. Appl. No. 13/895,656, filed May 16, 2013, Yoshida et al.
U.S. Appl. No. 14/095,279, filed Dec. 3, 2013, Suzuki et al.
Japanese Office Action (Application No. 2013-522998) dated Feb. 9, 2016 (with English translation).
European Search Report, European Application No. 12805346.9, dated Jan. 28, 2015 (5 pages).

* cited by examiner

HEAT EXCHANGE MEMBER

BACKGROUND OF THE INVENTION

1. Field of the Invention

The present invention relates to a heat exchange member using a honeycomb structure and being capable of exchanging heat between the first fluid and the second fluid.

2. Description of Related Art

In a heat exchanger, heat transfer is performed between a high-temperature fluid and a low-temperature fluid by a heat exchange member which conducts heat. In such a heat exchanger, a ceramic heat exchange member is used because there are cases of using a fluid having very high temperature or using a fluid which easily causes corrosion, such as water (e.g., Patent Document 1). The use of a ceramic heat exchange member enables to improve heat resistance and corrosion resistance.

In addition, a heat exchanger may expand by receiving heat from a high-temperature fluid or shrink by being deprived of heat by a low-temperature fluid. In particular, in a heat exchange member, a temperature difference is easily caused depending on the portions due to the temperature difference between the two kinds of fluids. Depending on the temperature difference, degree of shrinkage or expansion due to heat is varied with respect to each portion of the heat exchange member. As a result, large thermal stress may be caused locally in a specific portion in the heat exchange member. If there is locally caused a large thermal stress in a specific portion in the heat exchange member, breakage is easily caused in this portion. As a response to such a problem caused by thermal stress, the thickness of the portion having low mechanical strength is increased, or a reinforcing member is provided to obtain a structure having high mechanical strength.

PRIOR ART DOCUMENT

Patent Document

Patent Document 1: JP-A-61-24997

SUMMARY OF THE INVENTION

Problem to be Solved by the Invention

A heat exchange member is required to be used under severe conditions, and a heat exchange member capable of inhibiting breakage from being caused due to thermal stress is required.

The present invention aims to provide a heat exchange member which hardly generates breakage due to thermal stress by relaxing the thermal stress.

Means to Solve the Problem

The present inventors have found out that the aforementioned problem can be solved by forming a slit in the outer peripheral wall of a honeycomb structure constituting a heat exchange member. That is, according to the present invention, there is provided the following heat exchange member.

According to a first aspect of the present invention, a heat exchange member comprising: a honeycomb structure having ceramic as a main component and having a cylindrical outer peripheral wall and partition walls separating and forming a plurality of cells functioning as passages for a first fluid, a covering member for covering the honeycomb structure so that heat exchange can be carried out between the first fluid and a second fluid without mixing the first fluid flowing inside the honeycomb structure and the second fluid flowing outside the honeycomb structure; wherein the outer peripheral wall of the honeycomb structure has at least one slit, and the first fluid and the second fluid exchange heat by means of the outer peripheral wall of the honeycomb structure and the covering member in a state where the first fluid passing through the cells and the second fluid passing through the outside of the covering member are not mixed with each other, is provided.

According to a second aspect of the present invention, the heat exchange member according to the first aspect is provided, where at least one of the cells communicated with the slit in the outer peripheral wall is a partial cell having a different shape from that of the cells present inside.

According to a third aspect of the present invention, the heat exchange member according to the first or second aspects is provided, wherein a slit is formed in the partition walls forming the cells communicated with the slit in the outer peripheral wall.

According to a fourth aspect of the present invention, the heat exchange member according to any one of the first to third aspects is provided, wherein a plurality of slits are formed in the outer peripheral wall.

According to a fifth aspect of the present invention, the heat exchange member according to any one of the first to fourth aspects is provided, wherein a slit which is not communicated with the outer peripheral wall is formed.

According to a sixth aspect of the present invention, the heat exchange member according to any one of the first to fifth aspects is provided, wherein the slit in the outer peripheral wall is formed not over the entire length of the honeycomb structure but partially in the axial direction.

According to a seventh aspect of the present invention, the heat exchange member according to any one of the first to sixth aspects is provided, wherein a plurality of the honeycomb structures are disposed serially in the covering member, and the slit is formed in the outer peripheral wall of at least the honeycomb structure on the first fluid inlet side.

According to an eighth aspect of the present invention, the heat exchange member according to any one of the first to seventh aspects is provided, wherein at least one of the partition walls and the outer peripheral wall are/is densified.

According to a ninth aspect of the present invention, the heat exchange member according to any one of the first to eighth aspects is provided, where the main component of the honeycomb structure is silicon carbide.

Effect of the Invention

The formation of a slit in the outer peripheral wall of the honeycomb structure enables to relax thermal stress. This enables to inhibit breakage of the honeycomb structure.

DETAILED DESCRIPTION OF THE INVENTION

Hereinbelow, embodiments of the present invention will be described with referring to drawings. The present invention is not limited to the following embodiments, and changes, modifications, and improvements may be made as long as they do not deviate from the scope of the invention.

Figure 1A:
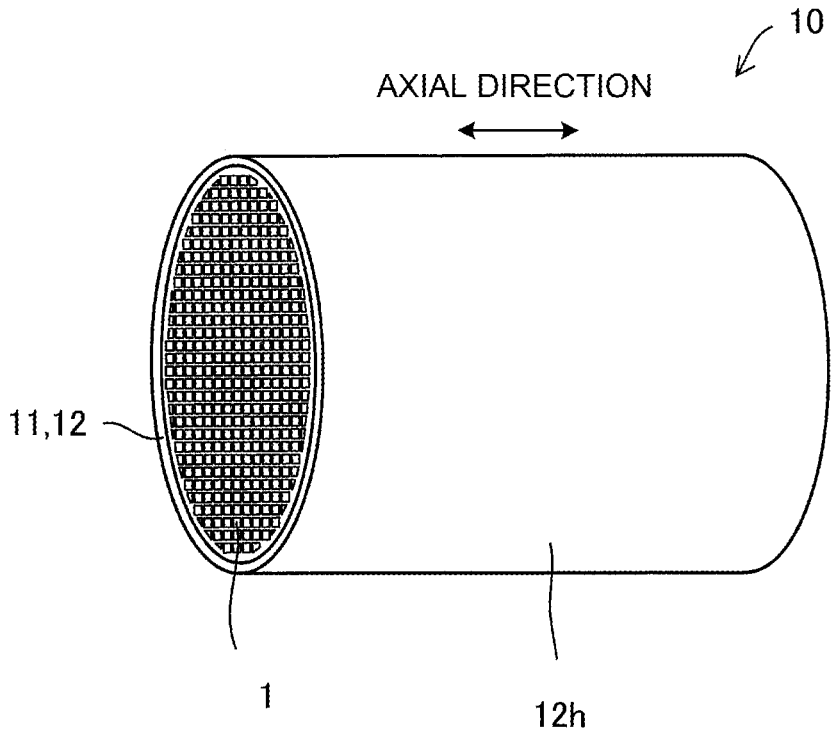
FIG. 1A is a perspective view showing an embodiment of a heat exchange member of the present invention.
Figure 1B:
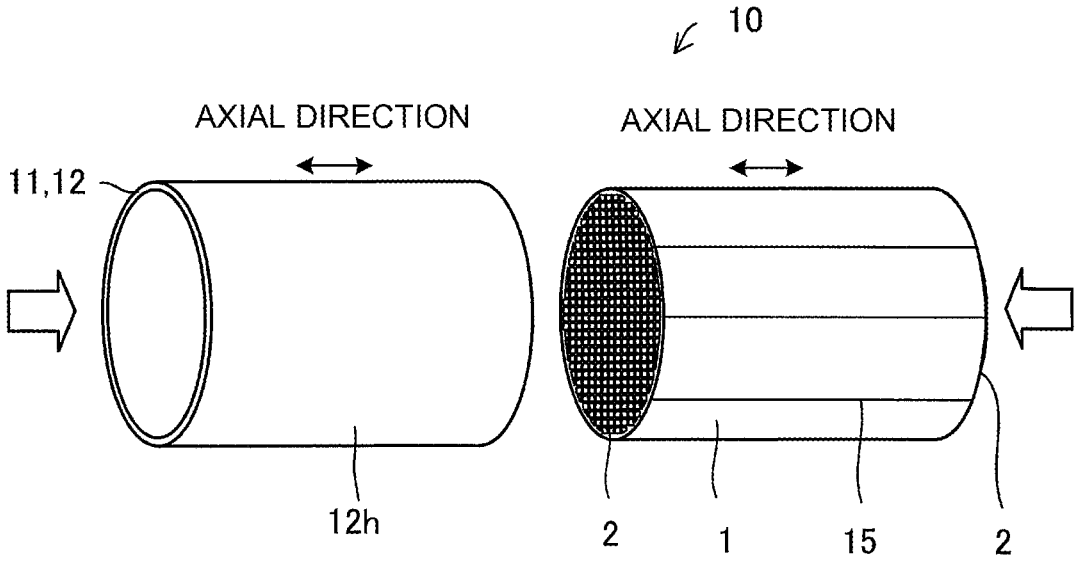
FIG. 1B is a perspective view showing the honeycomb structure and the covering member constituting the heat exchange member before they are unitarily joined.

FIG. 1A is a perspective view showing an embodiment of a heat exchange member 10 of the present invention. In addition, FIG. 1B is a perspective view showing the honeycomb structure 1 and the covering member 11 constituting the heat exchange member 10 before they are unitarily joined. Furthermore, FIG. 2 is a partially enlarged view of a honeycomb structure 1.

As shown in FIG. 1A, the heat exchange member 10 is provided with a honeycomb structure 1 and a covering member 11 (e.g., metal pipe 12). The honeycomb structure 1 has a cylindrical outer peripheral wall 7 and partition walls 4 separating and forming a plurality of cells 3 functioning as first fluid passages (see FIG. 2 and the like) and employs ceramic as the main component. In order to improve heat exchange efficiency, it is preferable that at least one of the partition walls 4 and the outer peripheral wall 7 are/is densified in the honeycomb structure 1. The densified ceramic has a porosity of preferably 20% or less, more preferably 10% or less, furthermore preferably 5% or less. As shown in FIG. 2, the honeycomb structure 1 has at least one slit 15 in the outer peripheral wall 7. In the embodiment shown in FIG. 1B, a plurality of slits 15 are formed in the outer peripheral wall 7 from one end face 2 to the other end face 2. The covering member 11 covers the honeycomb structure 1 so that heat can be exchanged between the first fluid and the second fluid (FIG. 1B shows the state before covering). The heat exchange member 10 exchanges heat between the first fluid and the second fluid by means of the outer peripheral wall 7 of the honeycomb structure 1 and the covering member 11 (metal pipe 12) in the state where the first fluid passing through the cells 3 and the second fluid passing outside the covering member 11 (e.g., metal pipe 12) are not mixed together.

Since the covering member 11 covers the outer peripheral face 7*h* of the honeycomb structure 1, heat exchange can be performed by passing the first fluid flowing inside the honeycomb structure 1 and the second fluid flowing outside the honeycomb structure 1 without being mixed together. When heat exchange between the first fluid and the second fluid is performed by conducting heat to the outer peripheral wall 7 and the partition walls 4, a temperature difference is caused depending on positions in the outer peripheral wall 7 and the partition walls 4. Such a temperature difference generates a difference in degree of expansion or shrinkage associated with heat, and, as a result, thermal stress is generated in the outer peripheral wall 7 or the partition walls 4. The thermal stress causes a strain or a crack in the outer peripheral wall 7 or the partition walls 4. In a heat exchange member 10 of the present invention, since at least one slit 15 is arranged in the outer peripheral wall 7 of the honeycomb structure 1, the thermal stress generated in the outer peripheral wall 7 can be relaxed, and a strain or crack generation in the outer peripheral wall 7 or the partition walls 4 can be inhibited.

Figure 2:
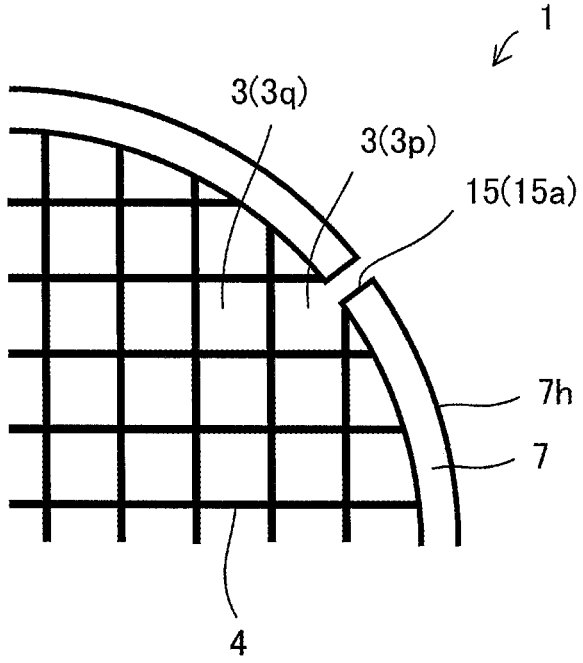
FIG. 2 is a partially enlarged view of a honeycomb structure.

As shown in FIG. 2, it is preferable that at least one of the cells 3 communicated with the slit 15 of the outer peripheral wall 7 is a partial cell 3*p* having a different shape from the inside cells 3 (complete cells 3*q*). In the partial cell 3*p*, the first fluid does not easily flow. By forming a slit 15 in the outer peripheral wall 7 forming the partial cell 3*p*, the opening area of the partial cell 3*p* is increased to improve the flow of the first fluid. That is, the formation of a slit 15 in the outer peripheral wall 7 forming the partial cell 3*p* enables to relax thermal stress and improve heat exchange efficiency.

It is preferable that the covering member 11 for covering the honeycomb structure 1 has good heat conductivity, heat resistance, and corrosion resistance without allowing the first fluid and the second fluid to flow therethrough. As materials for the covering member 11, a metal pipe 12, a ceramic pipe, and the like can be mentioned. As materials for the metal pipe 12, for example, stainless steel, titanium alloy, copper alloy, aluminum alloy, and brass may be used. In addition, the covering member 11 is not limited to a pipe, and a metal plate or a ceramic plate may be used. Alternatively, it is possible to coat the honeycomb structure 1 with a resin to be used as the covering member 11.

The honeycomb structure 1 is formed of ceramic into a cylindrical shape and has fluid passages from one end face 2 to the other end face 2 in the axial direction. The honeycomb structure 1 has partition walls 4, and a large number of cells 3 functioning as fluid passages are separated and formed by the partition walls 4. Possession of the partition walls 4 enables to efficiently collect heat from the fluid passing inside the honeycomb structure 1 and transfer the heat outside.

The external shape of the honeycomb structure 1 is not limited to a cylindrical (circular columnar) shape, and a cross section perpendicular to the axial (longitudinal) direction may have an elliptic shape. In addition, the external shape of the honeycomb structure 1 may be a prismatic shape. That is, a cross-section perpendicular to the axial (longitudinal) direction may have a quadrangular shape or another polygon.

In a heat exchange member 10 of the present invention, since the honeycomb structure 1 contains ceramic as the main component, the coefficient of thermal conductivity of the partition walls 4 and the outer peripheral wall 7 is raised, and, as a result, the heat exchange where the partition walls 4 and the outer peripheral wall 7 are interposed can be performed efficiently. Incidentally, to contain ceramic as the main component in the present specification means to contain ceramic at 50% by mass or more.

In the honeycomb structure 1, it is preferable that SiC (silicon carbide) having high heat conductivity is the main component in consideration of heat-transfer performance in particular. Incidentally, the main component means that 50% by mass or more of the honeycomb structure 1 is silicon carbide.

More specifically, as the materials for the honeycomb structure 1, Si-impregnated SiC, (Si+Al)-impregnated SiC, metal composite SiC, recrystallized SiC, $Si_3N_4$, SiC, or the like may be employed. However, in the case of a porous body, it may be impossible to obtain a high coefficient of thermal conductivity. Therefore, in order to obtain a high heat exchange efficiency, a densified body structure (a porosity of 20% or less) is preferable, and it is preferable to employ Si-impregnated SiC or (Si+Al)-impregnated SiC. SiC has characteristics of high coefficient of thermal conductivity and easy heat release whereas Si-impregnated SiC is densely formed and shows sufficient strength as a heat transfer member while showing high coefficient of thermal conductivity and heat resistance. For example, a densified body can have 100 W/m·K whereas, in the case of a SiC (silicon carbide) porous body, it is about 20 W/m·K.

As a cell shape of a cross section perpendicular to the axial direction of a cell 3 of the honeycomb structure 1, a desired shape may appropriately be selected from a circle, an ellipse, a triangle, a quadrangle, a hexagon, other polygons, and the like.

There is no particular limitation on the cell density (the number of cells per unit cross-sectional area) of the honeycomb structure 1, and it can be designed appropriately according to the purpose. However, the density is preferably within the range from 25 to 2000 cells/sq.in. (4 to 320 cells/$cm^2$). By controlling the cell density to 25 cells/sq.in. or more, strength of the partition walls 4, and eventually the strength and the effective GSA (geometric surface area) of the honeycomb structure 1 itself can be sufficient. By controlling it to 2000 cells/sq.in. or less, increase in pressure loss can be inhibited when a heat medium flows.

The thickness of the partition walls 4 (wall thickness) of the cells 3 of the honeycomb structure 1 is not particularly limited and may appropriately be designed according to the purpose. The wall thickness is preferably 50 μm to 2 mm, more preferably 60 to 500 μm. By controlling the wall thickness to be 50 μm or more, mechanical strength is improved, and breakage is hardly caused due to shock or thermal stress. On the other hand, when it is made to be 2 mm or less, there is caused no defect such as increase in the pressure loss of the fluid or decrease in heat exchange efficiency of heat medium permeation.

It is preferable that the density of the partition walls 4 of the cells 3 of the honeycomb structure 1 is 0.5 to 5 g/$cm^3$. By controlling the density to 0.5 g/$cm^3$ or more, the partition walls 4 can have sufficient strength, and breakage of the partition walls 4 due to pressure can be inhibited when the first fluid passes through the passages. In addition, by controlling the density to 5 g/$cm^3$ or less, the weight of the honeycomb structure 1 can be reduced. The density within the aforementioned range enables to obtain a strong honeycomb structure 1 and an effect of improving the coefficient of thermal conductivity.

The honeycomb structure 1 has a coefficient of thermal conductivity of preferably 100 W/m·K or more, more preferably 120 to 300 W/m·K, furthermore preferably 150 to 300 W/m·K. This range makes the heat conductivity good and enables the heat in the honeycomb structure 1 to be discharged efficiently outside the covering member 11 (metal pipe 12).

In a heat exchange member 10 of the present invention, in the case of passing exhaust gas as the first fluid, it is preferable to load a catalyst on the partition walls 4. The load of the catalyst on the partition walls 4 enables to convert CO, NOx, HC, and the like in the exhaust gas into harmless substances by a catalytic reaction and, in addition to this, enables to use the reaction heat generated upon the catalytic reaction for the heat exchange. The catalyst used for a heat exchange member 10 of the present invention preferably contains at least one element selected from the group consisting of noble metals (platinum, rhodium, palladium, ruthenium, indium, silver, and gold), aluminum, nickel, zirconium, titanium, cerium, cobalt, manganese, zinc, copper, tin, iron, niobium, magnesium, lanthanum, samarium, bismuth, and barium. These catalysts may be metals, oxides, or other compounds.

The amount of the catalyst (catalyst metal+carrier (the sum of the catalyst metal and the carrier carrying the catalyst metal)) loaded on the partition walls 4 of the cells 3 of the first fluid passage portion 5 of the honeycomb structure 1 where the first fluid (high temperature side) passes is preferably 10 to 400 g/L, and if it is noble metal, further preferably 0.1 to 5 g/L. When the amount of the catalyst (catalyst metal+carrier) is 10 g/L or more, the catalytic action is easily exhibited. On the other hand, when it is 400 g/L or less, the pressure loss can be inhibited, and the rise in production costs can be inhibited.

Figure 3:
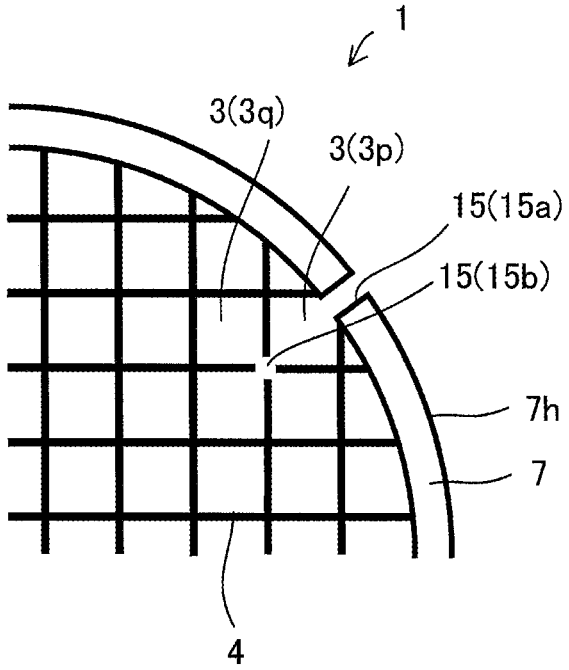
FIG. 3 is a schematic view showing an embodiment where a slit is formed in a partition wall forming the cell communicated with the slit in the outer peripheral wall.
Figure 4:
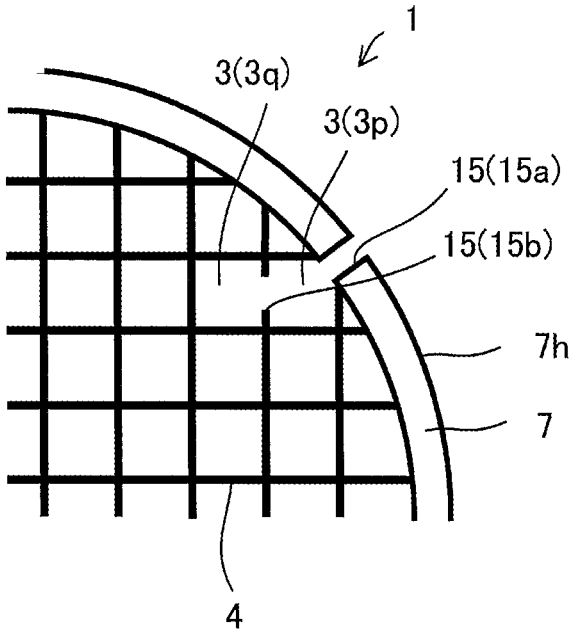
FIG. 4 is a schematic view showing another embodiment where a slit is formed in a partition wall forming the cell communicated with the slit in the outer peripheral wall.

Next, another embodiment of the slit 15 formed in the honeycomb structure 1 constituting the heat exchange member 10 will be described. FIGS. 3 and 4 show the embodiment where a slit 15 (15*b*) is formed in the partition walls 4 forming the cell 3 communicated with the slit 15 (15*a*) of the outer peripheral wall 7. In FIG. 3, a slit 15 (15*b*) is formed in the intersection portion of the partition walls 4. In FIG. 4, a slit 15 (15*b*) is formed in the middle of a side of the partition wall 4. As shown in FIGS. 3 and 4, it is preferable that a slit 15 (15*b*) is formed in the partition wall 4 forming the cell 3 communicated with the slit 15 (15*a*) in the outer peripheral wall 7 to relax the thermal stress. In addition, the slit width of the slit 15 (15*a*) formed in the outer peripheral wall 7 and the slit width of the slit 15 (15*b*) formed in the partition wall 4 is not necessarily the same, and it is one of the preferable embodiments that the slit width is different. The aforementioned embodiment enables to obtain an effect of relaxing the thermal stress and an effect of suppressing pressure loss without lowering the isostatic strength (ISO strength). When the ISO strength of the honeycomb structure 1 is decreased, the honeycomb structure 1 may break in the covering step for covering the honeycomb structure 1 with the covering member 11 or at the time of practical use.

Figure 5:
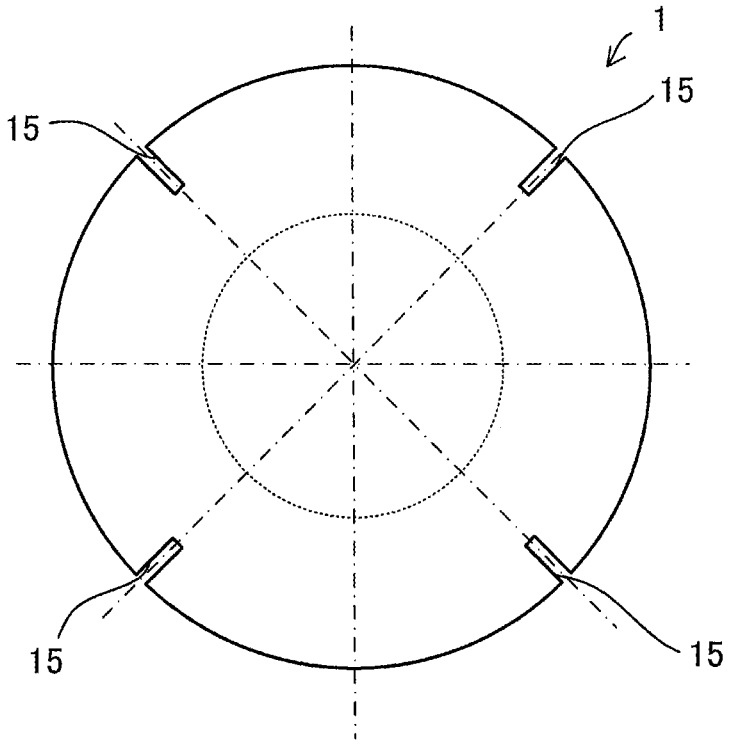
FIG. 5 is a schematic view showing an embodiment where a plurality of slits are formed in the outer peripheral wall.

FIG. 5 shows an embodiment where a plurality of slits 15 are formed in the outer peripheral wall 7. FIG. 5 is a schematic view where a cross section in the axial direction of the honeycomb structure 1 is simplified. The slit 15 may be formed not only in the outer peripheral wall 7, but also in the partition walls 4. A plurality of slits 15 formed in the outer peripheral wall 7 enables to obtain the effect of relaxing the thermal stress.

Figure 6:
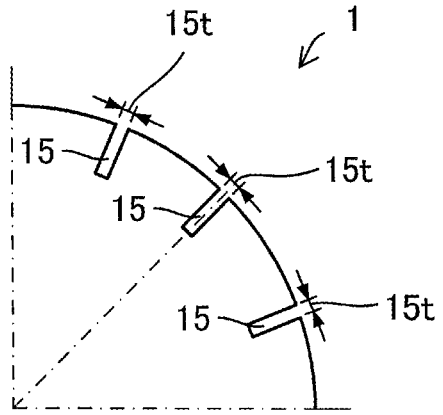
FIG. 6 is an explanatory view for explaining about the width of slits.

FIG. 6 shows an explanatory view for explaining about the width of slits 15. The total length of the width 15*t* of the slits 15 is preferably 50% or less, more preferably 30% or less, of the entire peripheral length (length of one round) of the outer peripheral wall 7. The total of the width 15*t* of the slits 15 means the total of the length of the width 15*t* of the plurality of slits 15 formed in the outer peripheral wall 7. Such a range enables to relax the thermal stress without lowering the ISO strength. Incidentally, though there is no particular limitation on the width of one slit 15, it is preferably 0.03 to 5 mm, and more preferably 0.1 to 2 mm, furthermore preferably 0.3 to 1.1 mm. The aforementioned range enables to inhibit the production costs from increasing with sufficiently relaxing the thermal stress.

Figure 7A:
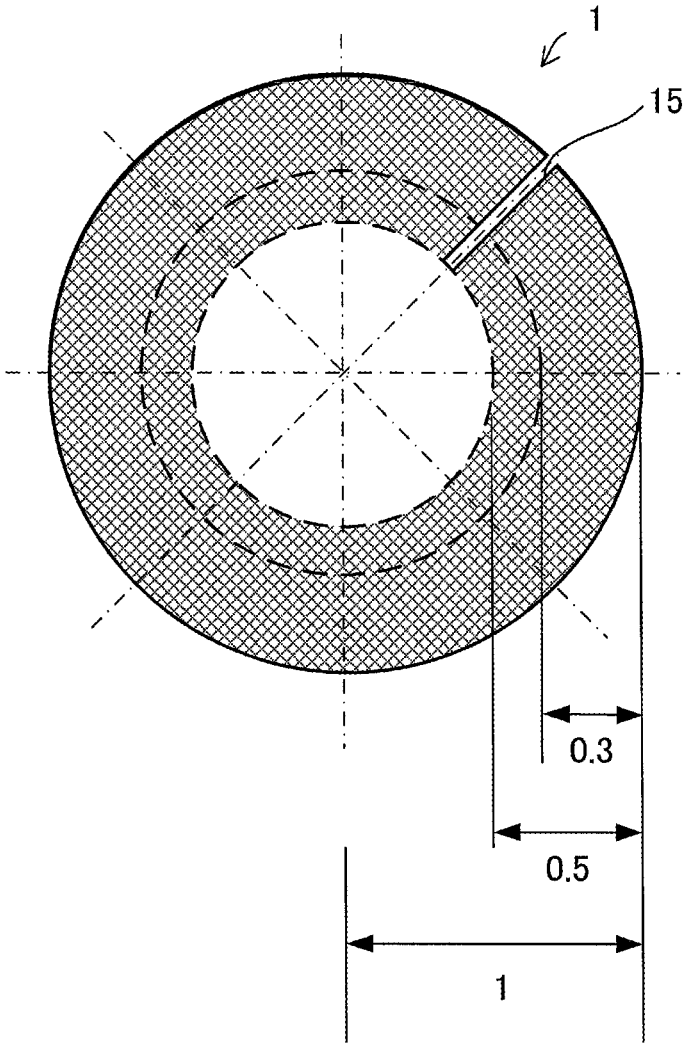
FIG. 7A is an explanatory view for explaining about the region where a slit communicated with the outer peripheral wall is present.
Figure 7B:
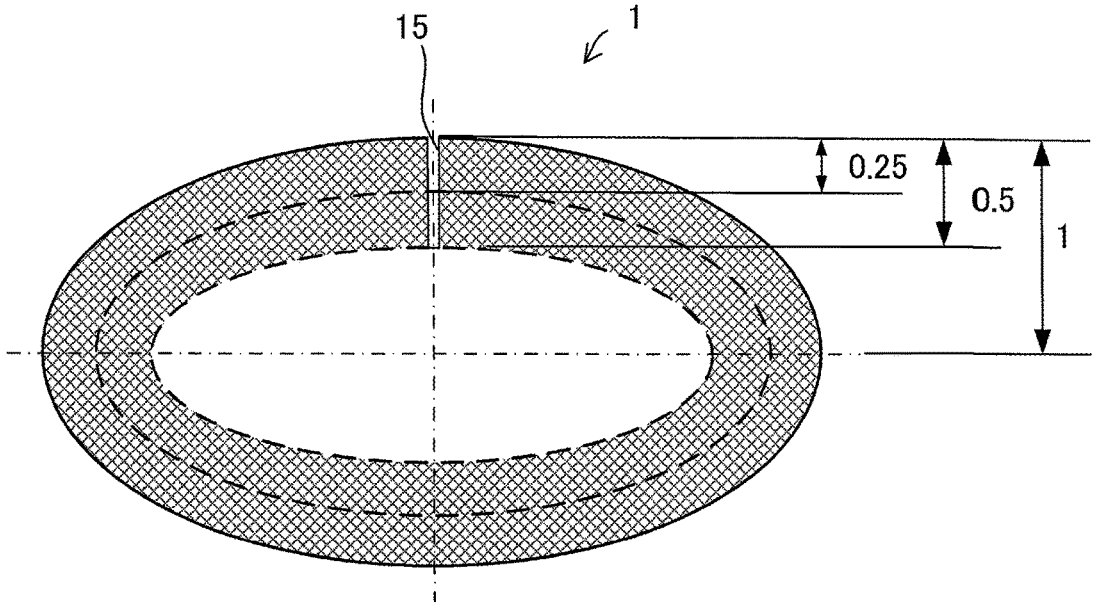
FIG. 7B is an explanatory view for explaining about the region where a slit communicated with the outer peripheral wall is present in an embodiment where the honeycomb structure has an elliptic cross section.

FIG. 7A shows an explanatory view for explaining the region where the slit 15 communicated with the outer peripheral wall 7 is present. In the embodiment of FIG. 7A, the slit 15 is formed in the outer peripheral wall 7 and formed in the region outside of 50% of the diameter from the outer peripheral wall 7 to the center of the honeycomb structure 1 in the diametral direction. That is, the region where the slit 15 communicated with the outer peripheral wall 7 is preferably the region outside of 50% (mesh region of the drawing), more preferably the region outside of 30%, of the diameter. Such a range enables to relax the thermal stress without lowering the ISO strength. FIG. 7B is an explanatory view for explaining about the region where a slit 15 communicated with the outer peripheral wall 7 is present in an embodiment having an elliptic cross section of the honeycomb structure 1. In order to suppress the decrease in ISO strength, it is preferable that the slit 15 is present in the region outside of 50% of the shorter diameter, and it is more preferable that the slit 15 is present in the region outside of 25%. When the ISO strength of the honeycomb structure 1 is reduced, the honeycomb structure 1 may break in a covering step for covering the honeycomb structure 1 with the covering member 11.

Figure 8:
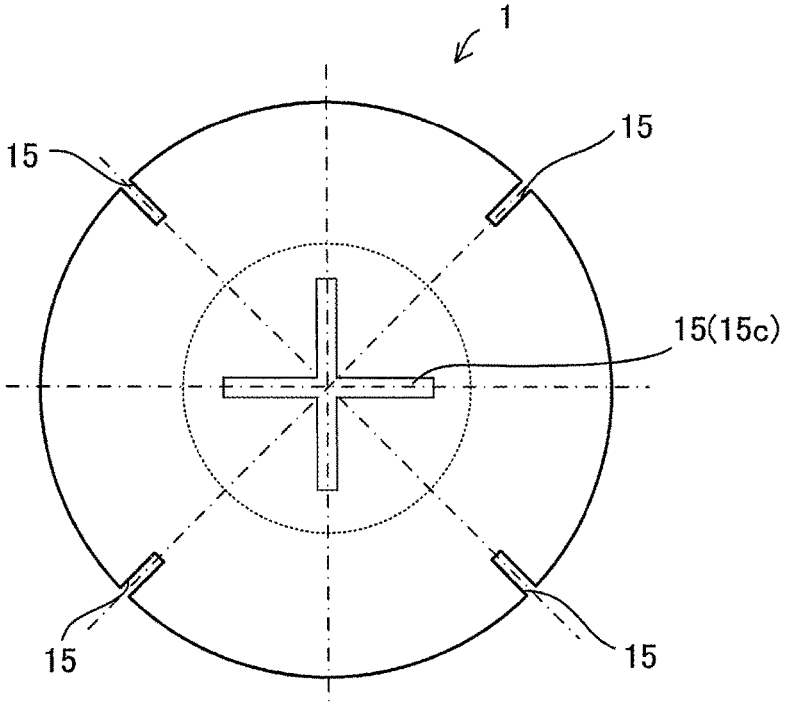
FIG. 8 is a schematic view showing an embodiment where a slit which is not communicated with the outer peripheral wall is formed.

FIG. 8 shows an embodiment where slits 15 which are not communicated with the outer peripheral wall 7 are formed. As shown in FIG. 8, in this embodiment, slits 15 (15*c*) which are not communicated with the outer peripheral wall 7 are formed in the partition walls 4. In the present embodiment, the slits 15*c* have a cross-shaped cross section perpendicular to the axial direction. Since the slits 15*c* are not communicated with the outer peripheral wall 7, the ISO strength is hardly lowered. In addition, the slits 15*c* can inhibit pressure loss of the first fluid from being reduced and can increase the flow rate of the first fluid. The shape of the slits 15*c* which are not communicated with the outer peripheral wall 7 is not limited to that of the present embodiment.

Figure 9:
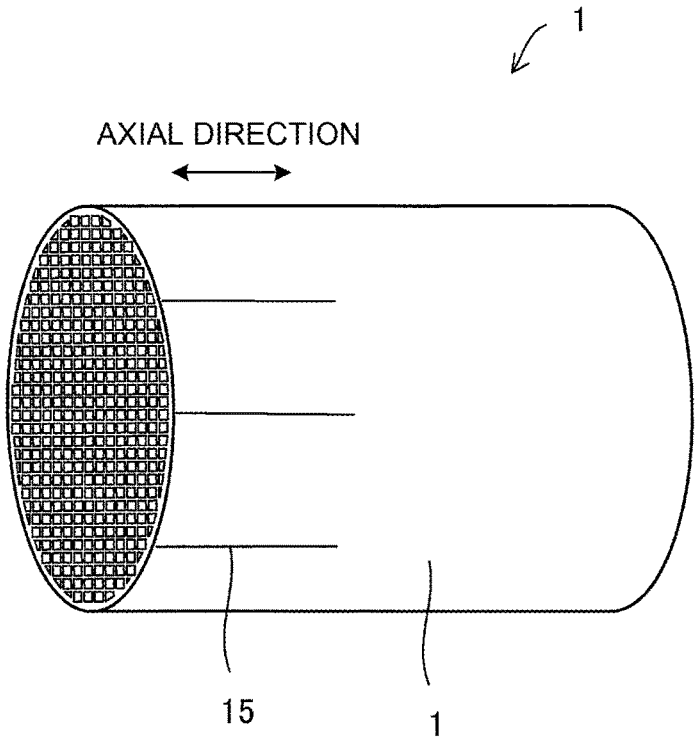
FIG. 9 is a schematic view showing an embodiment where slits are formed in a part in the axial direction of the honeycomb structure.

FIG. 9 is a schematic view showing an embodiment where slits 15 are formed in a part in the axial direction of the honeycomb structure 1. The slits 15 in the outer peripheral wall 7 may be formed not over the entire length of the honeycomb structure 1 but in a part in the axial direction. Formation of such slits 15 enables to relax the thermal stress while improving the flow of the first fluid. In the present embodiment, since the time for machining the slits 15 can be shortened, the costs can be reduced.

Figure 10:
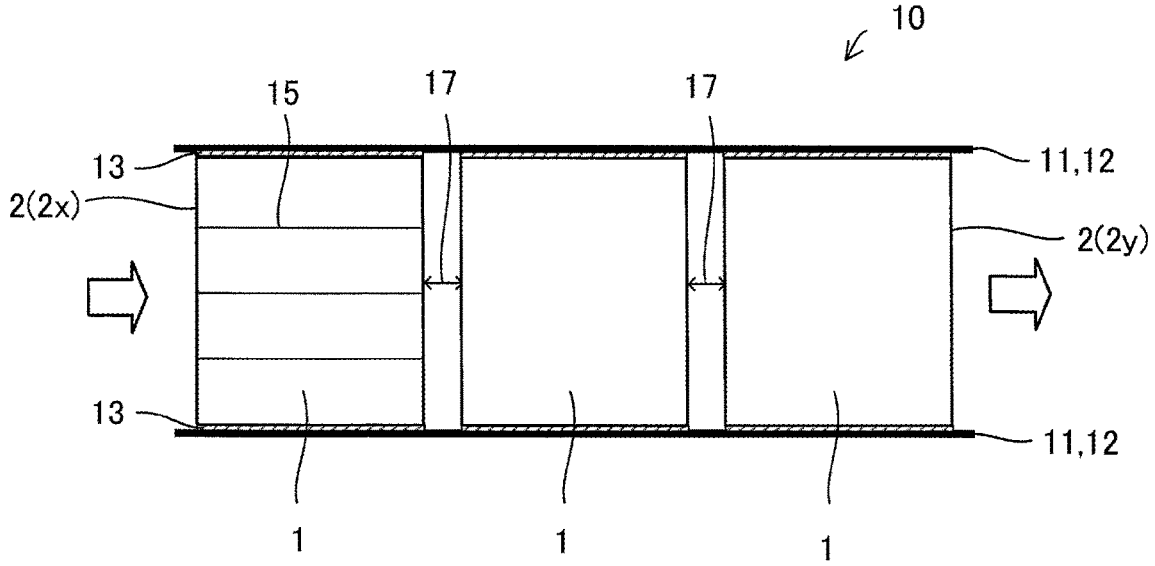
FIG. 10 is a schematic view showing an embodiment where a plurality of honeycomb structures are serially disposed in a metal pipe and where slits are formed in the outer peripheral wall of the honeycomb structure on at least the first fluid inlet side.

FIG. 10 shows an embodiment where a plurality of honeycomb structures 1 are serially disposed in a metal pipe 12, which is a covering member 11, and where slits 15 are formed in the outer peripheral wall 7 of the honeycomb structure 1 on at least the first fluid inlet side. In this embodiment, the honeycomb structures 1 are serially disposed with a gap 17. By connecting honeycomb structures 1 with a gap 17, the first fluid flowing through the cells 3 is mixed in the gap 17, and the flow becomes turbulent in comparison with the case having no gap 17 between the honeycomb structures 1. This facilitates heat transfer from the first fluid to the partition walls 4 and the outer peripheral walls 7 and improves the heat exchange efficiency. In addition, since slits 15 are formed in the outer peripheral wall 7 of the honeycomb structure 1 on the inlet side, the thermal stress can be relaxed with improving the flow of the first fluid.

In addition, it is preferable to unitary join them by shrink fitting in a state where an intermediate material 13 made of a graphite sheet is sandwiched between the metal pipe 12 and the honeycomb structure 1. The shrink fitting with the intermediate material 13 of a graphite sheet makes heat transfer good by the pressure applied to the graphite sheet in the environment of ordinary temperature to 150° C. upon use.

It is also one of the desirable embodiments that the entire length of the metal pipe 12 is longer than the entire length of the honeycomb structure 1 by 0.1 mm or more. As in FIG. 10, in the case where the honeycomb structures 1 are disposed with a gap 17, it is preferable that the entire length of the metal pipe 12 is larger than the length of the total of the length of the plural honeycomb structures 1 and the length of the gaps 17 by 0.1 mm or more. As shown in FIG. 1B, in the case where one honeycomb structure 1 is engaged with the metal pipe 12, it is preferable that the entire length of the metal pipe 12 is larger than the entire length of the honeycomb structure 1 by 0.1 mm or more. That is, it is preferable that the end faces 2 in the axial direction of the honeycomb structure 1 (as in FIG. 10, in the case that a plurality of honeycomb structures 1 are disposed, the inlet side end face 2*x* of the honeycomb structure 1 closest to the inlet side and the end face 2*y* on the outlet side of the honeycomb structure 1) are located inside the metal pipe 12. The design of making the metal pipe 12 longer enables to sufficiently exhibit heat exchange performance. In addition, upon producing a heat exchanger 30 using a heat exchange member 10, machining is easy.

Next, a method for manufacturing a heat exchange member 10 of the present invention will be described. In the first place, a kneaded material containing a ceramic powder is extruded into a desired shape to obtain a honeycomb formed body. As the material for the honeycomb structure 1, the aforementioned ceramic materials can be employed. For example, in the case of manufacturing a honeycomb structure 1 containing Si-impregnated SiC composite material as the main component, a predetermined amount of C powder, SiC powder, binder, and water or an organic solvent are kneaded to prepare a kneaded material, which is then formed to obtain a honeycomb formed body having a desired shape.

Then, the honeycomb formed body is dried and fired to obtain a honeycomb structure 1 where a plurality of cells 3 functioning as fluid passages are separated and formed by the partition walls 4. Though there is no particular limitation on the method for machining the slits, and there may be employed grinding, cutting, laser processing, water jet processing, electro-discharge machining (EDM), or the like. It is one of the preferable embodiments that slits are formed in the honeycomb formed body before firing. By processing before firing, the increase in production costs can be suppressed with minimizing damages on the processed face. Subsequently, the temperature of the metal pipe 12 functioning as a covering member 11 is raised, and the honeycomb structure 1 is inserted in the metal pipe 12 for unitary joining by shrink fitting, thereby forming a heat exchange member 10. Incidentally, for joining the honeycomb structure 1 and the covering member 11, brazing, diffusion joining, or the like maybe employed besides shrink fitting. The covering member 11 is not limited to the metal pipe 12.

Figure 11:
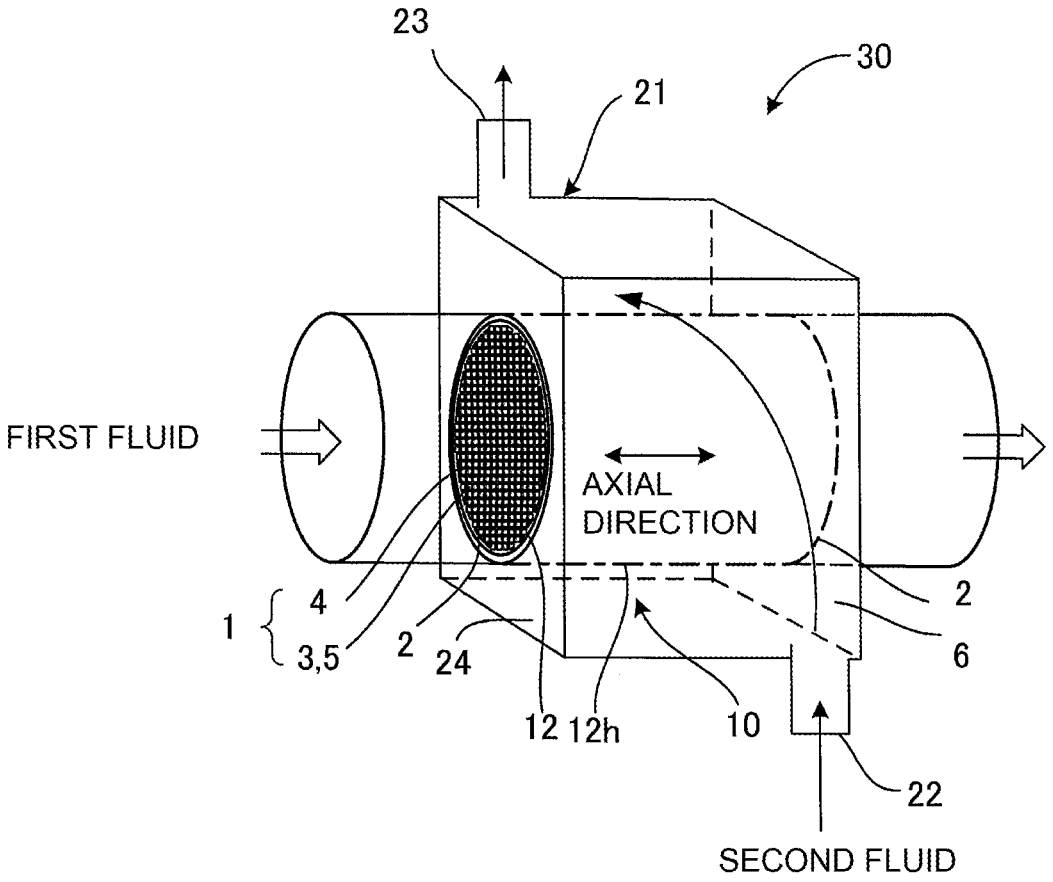
FIG. 11 is a schematic view showing a heat exchanger where a heat exchange member is contained.

FIG. 11 shows a perspective view of a heat exchanger 30 containing a heat exchange member 10 of the present invention. As shown in FIG. 11, the heat exchanger 30 is formed of the heat exchange member 10 and the casing 21 containing the heat exchange member 10 therein. The cells 3 of the honeycomb structure 1 function as the first fluid flow portion 5 where the first fluid passes. The heat exchanger 30 is configured so that the first fluid having higher temperature than the second fluid passes through the cells 3 of the honeycomb structure 1. In addition, the inlet port 22 and the outlet port 23 of the second fluid are formed in the casing 21, and the second fluid passes over the outer peripheral face 12*h* of the metal pipe 12 of the heat exchange member 10.

That is, the second fluid flow portion 6 is formed by the inside face 24 of the casing 21 and the outer peripheral face 12*h* of the metal pipe 12. The second fluid flow portion 6 is the passage portion for the second fluid formed by the casing 21 and the outer peripheral face 12*h* of the metal pipe 12 and separated by the partition walls 4 and the metal pipe 12 of the honeycomb structure 1 from the first fluid flow portion 5 to be able to conduct heat. That is, the heat exchanger 30 receives the heat of the first fluid flowing through the first fluid flow portion 5 by means of the partition walls 4 and the metal pipe 12 and transfers the heat to the body to be heated, which is the second fluid. The first fluid and the second fluid are completely separated from each other, and it is configured lest these fluids should be mixed together.

It is preferable that the heat exchanger 30 allows the first fluid having higher temperature than the second fluid to flow to conduct the heat from the first fluid to the second fluid. By allowing gas to flow as the first fluid and allowing liquid to flow as the second fluid, heat exchange between the first fluid and the second fluid can be performed efficiently. That is, a heat exchanger 30 of the present invention can suitably be used as a gas/liquid heat exchanger.

As the heating body, which is the first fluid allowed to flow through a heat exchanger 30 of the present invention having the aforementioned configuration, there is no particular limitation as long as it is a medium having heat, such as gas and liquid. For example, an automobile exhaust gas can be mentioned as the gas. In addition, there is no particular limitation on the body to be heated as the second fluid, which takes heat (exchanges heat) from the heating body, as long as it is a medium having lower temperature than the heating body, such as gas and liquid.

EXAMPLE

Hereinbelow, the present invention will be described in more detail on the basis of Examples. However, the present invention is by no means limited to these Examples.

(Manufacturing of Honeycomb Structure)

A kneaded material was prepared by mixing appropriate amounts of SiC, an organic binder (methyl cellulose), water, and the like, and kneading the mixture. The kneaded material was extruded to form a honeycomb shape having a circular columnar exterior appearance and dried to obtain a formed body. Then, the formed body was subjected to Si-impregnation firing to obtain a honeycomb structure 1 (having a diameter of 42 mm, a length of 100 mm, a partition wall 4 thickness of 0.4 mm, and a cell density of 150 cpsi) containing silicon carbide as the main component.

(Slit Formation)

With respect to the outer peripheral wall 7 of the formed body before Si-impregnation or the honeycomb structure 1 after the Si-impregnation firing, machining of slits having a predetermined depth was carried out by using a diamond grinding stone having a grinding stone width of 0.3 to 0.9 mm.

(Metal Pipe)

A stainless steel metal pipe 12 was engaged with the outer peripheral face 7*h* of the honeycomb structure 1 by shrink fitting to manufacture a heat exchange member 10 (see FIG. 1B).

(Casing)

The heat exchange member 10 was arranged in a stainless steel casing 21 (see FIG. 11).

(Heat Exchange Efficiency Test)

As described above, there were used heat exchangers 30 manufactured by putting the heat exchange members 10 of Examples and Comparative Examples in stainless steel containers (casings). There was measured the heat-transfer efficiency to the second fluid at the time of passing the first fluid through the cells 3 of the honeycomb structure 1 of the heat exchange member 10. Nitrogen gas ($N_2$) was used as the first fluid and passed through the cells 3 of the first fluid passage portion 5 of the honeycomb structure 1 at a SV (space velocity) of $50000^{h-1}$ at 350° C. As the second fluid, water was used and passed through the second fluid passage portion 6 in the casing at a flow rate of 10 L/min. at 40° C. The temperature of the first fluid flowing 20 mm upstream from the inlet port of the cells 3 of the heat exchange member 10 was defined as "inlet port gas temperature", and the temperature of the first fluid flowing 200 mm downstream from the outlet port of the cells 3 was defined as "outlet port gas temperature". The temperature of the water passing through the inlet port of the casing 21 was defined as the "inlet port water temperature".

Heat exchange efficiency (%)=(inlet port gas temperature−outlet port gas temperature)/(inlet port gas temperature−inlet port water temperature)×100

(Heat Resistance Test)

There were used nitrogen gas ($N_2$) having a temperature of 500° C. as the first fluid and water having a temperature of 20° C. as the second fluid.

(Evaluation of Isostatic Strength (ISO Strength))

An urethane rubber sheet having a thickness of 0.5 mm was wound on the outer peripheral face 7*h* of the honeycomb structure 1, and an aluminum circular plate having a thickness of 20 mm was disposed on both the end faces 2 of the honeycomb structure 1 with a circular urethane rubber sheet being sandwiched therebetween. The aluminum circular plate and the urethane rubber sheet had the same radius as the radius of the end faces 2 of the honeycomb structure 1. By winding with a vinyl tape along the outer periphery of the aluminum circular plates, the gaps between the outer periphery of the aluminum circular plates and the urethane rubber sheet were sealed to obtain a test sample. The test sample obtained above was put in a pressure container containing water. With raising the pressure at a rate of 0.3 to 3.0 MPa/min. to apply hydrostatic pressure of 3.0 MPa to the test sample, and breakage and crack generation of a honeycomb structure 1 were confirmed. Presence/absence of crack generation was checked by confirming a breaking sound during the test and visually observing the external appearance of the honeycomb structure 1 after the test.

TABLE 1

| | Number of slits in outer peripheral wall | Slit position | Slit depth | Heat resistance test | Isostatic strength | Heat exchange efficiency % |
|---|---|---|---|---|---|---|
| Example 1 | 4 | Partial cell | Only outer peripheral wall | No crack | OK | 71 |
| Example 2 | 8 | Partial cell | Only outer peripheral wall | No crack | OK | 73 |
| Example 3 | 12 | Partial cell | Only outer peripheral wall | No crack | OK | 74 |
| Example 4 | 4 | Partial cell | Outer peripheral wall + 1 cell | No crack | OK | 71 |
| Example 5 | 4 | Complete cell | Only outer peripheral wall | No crack | OK | 70 |
| Comp. Ex. 1 | 0 | — | — | Crack present | OK | 70 |

As shown in Table 1, Examples 1 to 5 having slits 15 formed on the outer peripheral wall 7 had no problem regarding the heat resistance test and the isostatic strength. In addition, they had a heat exchange efficiency equivalent to or more than that of Comparative Example 1. On the other hand, Comparative Example 1 having no slit 15 formed therein had crack generation in the heat resistance test.

INDUSTRIAL APPLICABILITY

The heat exchange member of the present invention can be used for heat exchange between the heating body (high temperature side) and the boy to be heated (low temperature side). In particular, it is suitable for the case where at least one of the heating body and the body to be heated is liquid. In the case where it is used for exhaust heat recovery from exhaust gas in an automobile field, it can be used to improve fuel consumption of an automobile.

DESCRIPTION OF REFERENCE NUMERALS

1: honeycomb structure, 2, 2*x*, 2*y*: end face (in the axial direction), 3: cell, 3*p*: partial cell, 3*q*: complete cell, 4: partition wall, 5: first fluid flow portion, 6: second fluid flow portion, 7: outer peripheral wall, 7*h*: outer peripheral face (of honeycomb structure), 10: heat exchange member, 11: covering member, 12: metal pipe, 12*h*: outer peripheral face (of metal pipe), 13: intermediate material, 15: slit, 15*a*: slit (of outer peripheral wall), 15*b*: slit (of partition wall), 15*c*: slit (not communicated with outer peripheral wall), 15*t*: slit width, 17: gap, 21: casing, 22: inlet port (for the second fluid), 23: outlet port (of the second fluid), 24: inside face (of casing), 30: heat exchanger

The invention claimed is:

1. A heat exchange member comprising:

a honeycomb structure having ceramic as a main component and having a cylindrical outer peripheral wall and partition walls separating and forming a plurality of cells functioning as passages for a first fluid, a covering member covering the outer peripheral wall of the honeycomb structure so that the first fluid passing through the cells and a second fluid flowing outside the honeycomb structure are not mixed;

wherein the outer peripheral wall of the honeycomb structure has at least one slit, and the first fluid and the second fluid exchange heat by means of the outer peripheral wall of the honeycomb structure and the covering member in a state where the first fluid passing through the cells and the second fluid passing around the outside of the covering member are not mixed with each other.

2. The heat exchange member according to claim 1, where at least one of the cells communicated with the slit in the outer peripheral wall is a partial cell having a different shape from that of the cells present inside, the shape being partially formed by the outer peripheral wall.

3. The heat exchange member according to claim 2, wherein a slit is formed in the partition walls forming the cells communicated with the slit in the outer peripheral wall.

4. The heat exchange member according to claim 3, wherein a plurality of slits are formed in the outer peripheral wall.

5. The heat exchange member according to claim 4, wherein a slit which is not communicated with the outer peripheral wall is formed.

6. The heat exchange member according to claim 5, wherein the slit in the outer peripheral wall is formed not over the entire length of the honeycomb structure but partially in the axial direction.

7. The heat exchange member according to claim 6, wherein a plurality of the honeycomb structures are disposed serially in the covering member, and the slit is formed in the outer peripheral wall of at least the honeycomb structure on the first fluid inlet side.

8. The heat exchange member according to claim 7, wherein at least one of the partition walls and the outer peripheral wall are/is densified.

9. The heat exchange member according to claim 8, wherein the main component of the honeycomb structure is silicon carbide.

10. The heat exchange member according to claim 1, wherein a slit is formed in the partition walls forming the cells communicated with the slit in the outer peripheral wall.

11. The heat exchange member according to claim 1, wherein a plurality of slits are fanned in the outer peripheral wall.

12. The heat exchange member according to claim 11, wherein at least one of the partition walls and the outer peripheral wall are/is densified.

13. The heat exchange member according to claim 12, wherein the main component of the honeycomb structure is silicon carbide.

14. The heat exchange member according to claim 12, where at least one of the cells communicated with the slit in the outer peripheral wall is a partial cell having a different shape from that of the cells present inside, the shape being partially formed by the outer peripheral wall.

15. The heat exchange member according to claim 1, wherein a slit which is not communicated with the outer peripheral wall is formed.

16. The heat exchange member according to claim 1, wherein the slit in the outer peripheral wall is formed not over the entire length of the honeycomb structure but partially in the axial direction.

17. The heat exchange member according to claim 1, wherein a plurality of the honeycomb structures are disposed serially in the covering member, and the slit is formed in the outer peripheral wall of at least the honeycomb structure on the first fluid inlet side.

18. The heat exchange member according to claim 1, wherein at least one of the partition walls and the outer peripheral wall are/is densified.

19. The heat exchange member according to claim 1, wherein the main component of the honeycomb structure is silicon carbide.

20. The heat exchange member according to claim 1, wherein at least one of the partition walls and the outer peripheral wall are/is densified and has/have a porosity of 20% or less.

21. The heat exchange member according to claim 1, wherein the first fluid and the second fluid exchange heat by means of the first fluid passing through the cells and the second fluid passing around the outer peripheral side of the covering member without being mixed with each other.

* * * * *